United States Patent [19]

Gertsch

[11] 4,219,217

[45] Aug. 26, 1980

[54] RELEASABLE TOE HOLDER FOR SKI BINDING

[75] Inventor: Ulrich Gertsch, Matten, Switzerland

[73] Assignee: S.A. ETS. Francois Salomon et Fils, Annecy, France

[21] Appl. No.: 919,051

[22] Filed: Jun. 26, 1978

[30] Foreign Application Priority Data

Jun. 29, 1977 [CH] Switzerland ..... 7957/77

[51] Int. Cl.[2] ..... A63C 9/085

[52] U.S. Cl. ..... 280/629

[58] Field of Search ..... 280/629, 630, 628, 626, 280/627, 613, 636, 618, 617, 611

[56] References Cited

U.S. PATENT DOCUMENTS

| | | | |
|---|---|---|---|
| 3,027,173 | 3/1962 | Beyl | 280/629 |
| 3,145,027 | 8/1964 | Berchtold et al. | 280/636 |
| 3,667,769 | 6/1972 | Wunder | 280/627 |
| 3,667,770 | 6/1972 | Lawrence | 280/629 |

*Primary Examiner*—John J. Love
*Assistant Examiner*—Milton L. Smith
*Attorney, Agent, or Firm*—Werner W. Kleeman

[57] ABSTRACT

A releasable toe holder or toe jaw for ski bindings having a sole holder movably mounted transversely with respect to the lengthwise direction of the related ski. The sole holder is retained in a normal position by a spring element and following a limited transverse movement thereof is returned back into such normal position by said spring element. The sole holder has a pedal intended to engage beneath the sole end of the ski boot. The sole holder is anchored to the ski by means of a double guide or link arrangement coupled with the spring element. One hinge or pivot of the double guide arrangement is fixedly arranged on the ski and a second hinge or pivot engages the pedal behind the sole holder.

9 Claims, 10 Drawing Figures

24
26a
90
26
25
10
11
6
23
12a
13
5
3
12
14
12b
15
4
41
27
18
2
9

RELEASABLE TOE HOLDER FOR SKI BINDING

BACKGROUND OF THE INVENTION

The present invention generally relates to the safety ski binding art, and, in particular, concerns a new and improved construction of a safety or releasable toe holder or jaw for ski bindings which is of the type having a sole holder movably mounted for transverse movement with respect to the lengthwise direction of the related ski and retained in a normal position by means of a spring element and returned back into the normal position by the spring element following a limited transverse movement thereof, the sole holder having a pedal intended to engage below the sole end of the ski boot, the free end of the pedal being displaceably retained in a plane parallel to the ski by a jaw element fixed to the ski.

According to one such safety or releasable toe jaw or holder as has become known to the art from Swiss Pat. No. 477,210 the pedal intended to engage below the front end of the sole of the ski boot is intended to reduce the friction between the ski boot sole and the ski. Specifically, this is supposed to be accomplished in that it is displaceably held in a plane parallel to the ski at its free end by a jaw element or part which is fixed to the ski. The uncontrollable friction between the ski boot sole and the surface of the ski and dependent upon a great many extraneous circumstances and happenstances is supposed to be eliminated and replaced by the controllable friction of the aforementioned ski binding element. With the heretofore known ski binding the sole holder, however, is guided in a complicated guide arrangement which following a certain transverse displacement renders possible a displacement towards the front. The region of the transverse displacement represents the so-called elastic region or range, the range where the spring element exerts a restoring force, so that the skier can catch his or herself and there is extensively eliminated faulty release action. However, if this range is exceeded, then with the prior art toe jaws the sole holder can move towards the front in accordance with the forwardly angled course of the guide arrangement, so that the ski boot is released from the sole holder or plate and/or the heel holder. The realization of such guide arrangement requires an appreciable constructional expenditure, and in the guide arrangement itself there arise new frictional losses which are also then appreciable if, as contemplated with such constructions, there are employed guide rolls instead of sliding guide elements. Additionally, such guide arrangements are open and extremely prone to contamination, the effects of moisture, snow and other extraneous influences. This means that the set release action does not remain constant, rather, for instance, due to contamination, ice and so forth, experiences appreciable fluctuations.

SUMMARY OF THE INVENTION

Hence, with the foregoing in mind it is a primary object of the present invention to provide an improved construction of safety toe holder or jaw for ski bindings which is not associated with the aforementioned drawbacks and limitations of the prior art constructions.

Still a further significant object of the present invention aims at the provision of a new and improved construction of releasable ski binding which is relatively simple in construction and design, economical to manufacture, extremely reliable in operation, not really subject to breakdown or malfunction, and requires a minimum of maintenance and servicing.

Another object of the present invention is to devise a new and improved construction of releasable toe holder structured such that the setting of the binding cannot be inadvertently altered nor affected by extraneous conditions, such as the effects of weather, snow, dirt, contamination and the like.

Yet a further significant object of the present invention is to guide the sole holder with closed guide means, in other words, guide means which are not endangered by contamination or weather effects and the like, in such a manner that the release characteristic within the elastic range has an as flat as possible course and within such range is particularly not affected by the contact of pressing force exerted in the lengthwise direction of the ski by the automatic heel holder.

In keeping with the immediately preceding object it is a further object of the present invention to provide a new and improved construction of safety toe holder which is contemplated to be predominantly, although not exclusively, used in conjunction with a modern step-in automatic heel holder.

Now in order to implement these and still further objects of the invention, which will become more readily apparent as the description proceeds, the sole holder is anchored to the ski by means of a double guide or link arrangement which is coupled with the spring element; the one pivot of the double guide or link arrangement is fixedly arranged on the ski and the second pivot or hinge engages a pedal behind the sole holder.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1' is an enlarged detail showing of the releasable toe holder of FIG. 1 in side view;

FIG. 2' is an enlarged detail showing of the releasable toe holder of FIG. 1 in top plan view;

DETAILED DESCRIPTION OF THE PREFERRED EMBODIMENTS

Figures 1, 2, 3, 4:
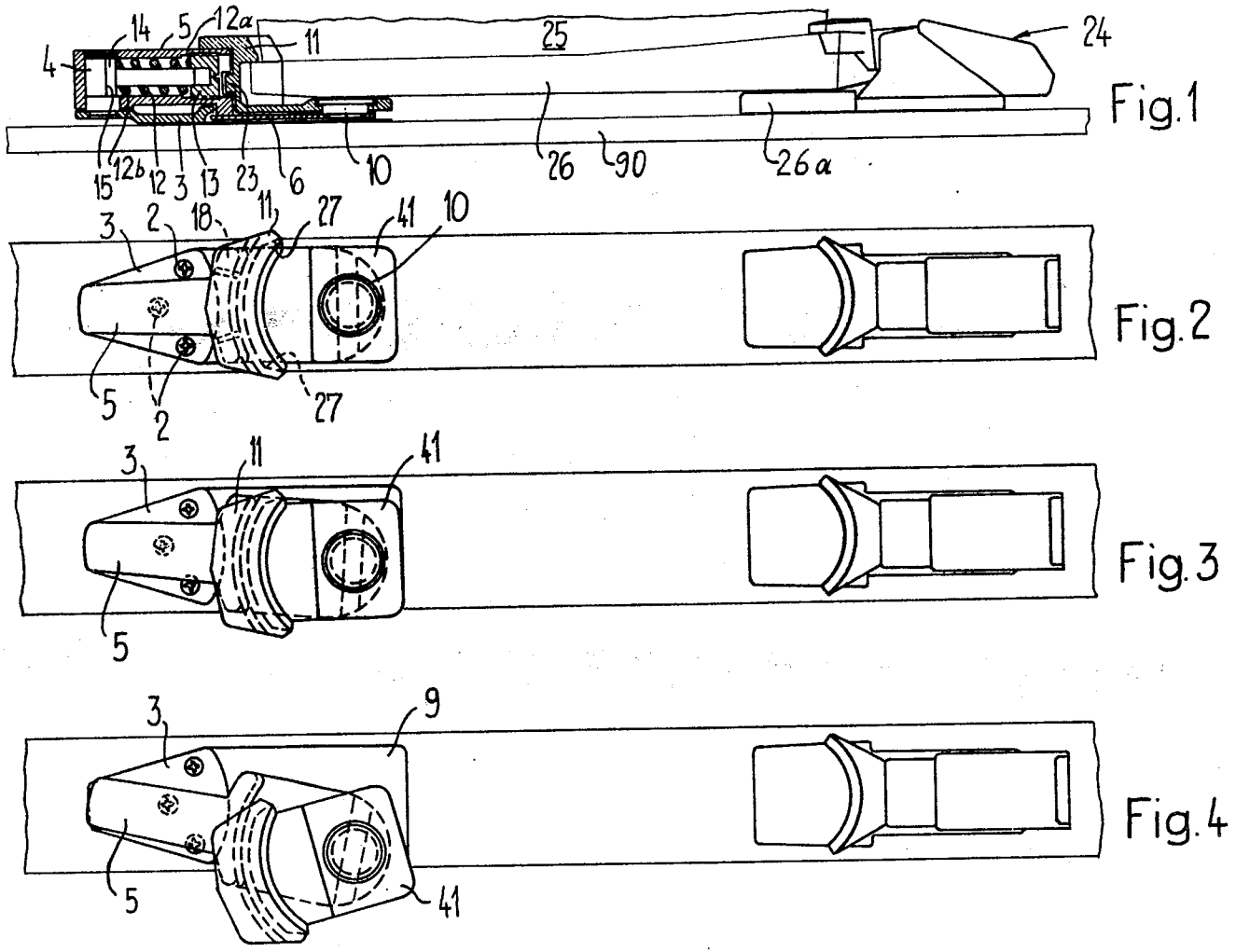
FIG. 1 is a side view, partially in cross-section of a first exemplary embodiment of safety ski binding constructed according to the teachings of the present invention.
FIGS. 2, 3 and 4 are respective top plan views of the safety ski binding shown in FIG. 1, particularly illustrating different operating positions of the releasable toe holder or jaw.

Describing now the drawings, as will be apparent from the showing of FIGS. 1, 2 and 1' and 2', with the first constructional embodiment of releasable toe holder or toe jaw, there is provided a double angled or flexed support or carrier plate 3 which is fixedly anchored to the ski by means of screws or threaded bolts 2 or equivalent fastening expedients. The support plate 3 carries at its front end 3*c* a bearing or pivot pin 4. Pivotably mounted on this bearing or pivot pin 4 is a spring housing 5 which, in its normal position, extends rearwardly in the lengthwise direction of the related ski, generally indicated in FIG. 1 by reference character 90. The rear end 5*a* of the spring housing 5 is connected by means of screws or threaded bolts 7 or equivalent fastening devices to a pivot plate 6. The forwardly protruding end 6' of the pivot plate 6 engages below the rear flexed or angled portion 3*b* of the support or carrier plate 3. The pivot plate 6 bears by means of a friction lining or layer 8 which is arranged at the rear end region 6*a* of such pivot plate 6 upon a steel plate 9 which is fixed to the ski 90. At the same rear end region 6*a* of the pivot or pivotable plate 6 there is provided a pivot pin 10 which extends through a hole 41*a* of a pedal 41 or equivalent structure connected with the sole holder or holddown 11, and thus, serves for the pivotal anchoring of the sole holder 11 to the pivot plate 6.

The spring housing 5 and pivot plate 6 form a double guide or link arrangement which is pivotable about the bearing or pivot pin 4 and the pivot pin 10. The sole holder or holddown 11 is anchored to the ski 90 by means of such double guide or link arrangement 5, 6. This double guide or link arrangement 5, 6 is retained in a so-called normal position by means of a spring element 12 arranged in the spring housing 5. This spring element 12 bears by means of its rear end 12*a* on an adjustment or setting screw 13 and by means of its front end 12*b* against a piston or plunger 14 guided in the spring housing 5. This piston 14 bears upon a rearwardly directed flattened surface 15 of the bearing or pivot pin 4.

Now between the forwardly directed substantially cylindrical end surface 16 of the sole holder 11 and the corresponding end surface 17 of the rear end 5*a* of the spring housing 5 which is widened into a socket 18 there are effective the latching or locking balls 19 which are inserted together with the related springs 20 into recesses 21 of the socket 18 and center the sole holder 11 in its normal position on the double guide or link arrangement 5, 6. The sole holder 11 and the socket 18 are guided with respect to one another by means of a groove 22 and a tongue 23. Reference character 24 generally designates an automatic heel holder which may be any of the commercially available types. This heel holder 24 engages over the heel 26*a* of the ski boot 25 and apart from exerting the holddown force on the ski boot sole 26, it also exerts a forwardly directed contact or pressing force. By virtue of this force the ski boot sole 26 is pressed against the forwardly converging lateral impact or stop surfaces 27. Also as a result thereof, if desired only as a result thereof, the sole holder 11 is retained in the normal position shown in FIG. 2, i.e., the locking balls 19 essentially only must undertake the function of retaining the sole holder 11 in its normal position prior to stepping into the binding.

The mode of operation of the described toe holder or jaw will be apparent from the showing of FIGS. 1 and 2, especially however, from the illustration of FIGS. 3 and 4. Now if the lateral force acts upon the ski boot 25 and if such lateral force exceeds the set or adjusted release value of the releasable toe holder or safety toe binding, then the double link or guide arrangement 5, 6 begins to rock as shown in FIG. 3. Since the length of the double guide or link arrangement 5, 6 is comparatively large, and in accordance with the inherent pivot arm represented by the pedal 41, the sole holder or holddown 11 moves in the elastic range essentially towards the side, with a comparatively negligible forwardly directed component, so that practically no relative movement exists between the pedal 41 and the ski boot sole 26 and the ski boot 25 rotates about the ski boot heel 26*a*. Again in consideration of the length of the double guide or link arrangement 5, 6 and the otherwise provided mounting of the sole holder 11 the pivot angle of the double guide arrangement 5, 6 is small within the elastic range illustrated in FIG. 3, and accordingly, the spring element 12 is only slightly compressed. This means that the spring force has a flat course in the elastic range. Nonetheless, the spring force is sufficient in order, if necessary, to bring about a restoring action, since the contact force within the elastic range does not have available to it any appreciable lever arm, and, furthermore, there can not be exerted upon the double guide or link arrangement 5, 6 any counter rotational moment which works opposite to the restoring rotational moment. As a result, there is obtained an optimum release and restoring characteristic, and accordingly, an optimum dampening behaviour. The ski binding can be properly adjusted and also still softly set, without there resulting any faulty release action. The encapsulated construction prevents any adverse effect upon the set release value by the effects of dirt or other contaminants, weather and the like. What is further worthy of mention is that although the toe holder or jaw has an appreciable lengthwise extent, nonetheless the ski is not stiffened against any bending-through, since the attachment (screws 2) is extremely concentrated. What is also advantageous is the closeness of the attachment to the sole holder 11. If the rocking or pivoting of the double guide or link arrangement 5, 6 exceeds the elastic range, as shown in FIG. 4, then the sole holder 11 has imparted to it an increasing forward component and the ski boot sole 26 is released therefrom and/or from the automatic heel holder 24. After the release action has been accomplished the sole holder 11 can be rocked back into the normal position without any great effort by means of a simple hand manipulation.

Instead of supporting the pivot pin 10 on the pivot plate 6 as has been shown, it is also possible to guide said pivot pin 10 through the pivot plate 6 and to support such on the steel plate 9 which is fixed to the ski 90. This solution has the advantage that the load acting upon the pivot pin 10 is not taken-up by the pivot plate 6 but rather by the ski 90.

Figures 5, 6, 7, 8:
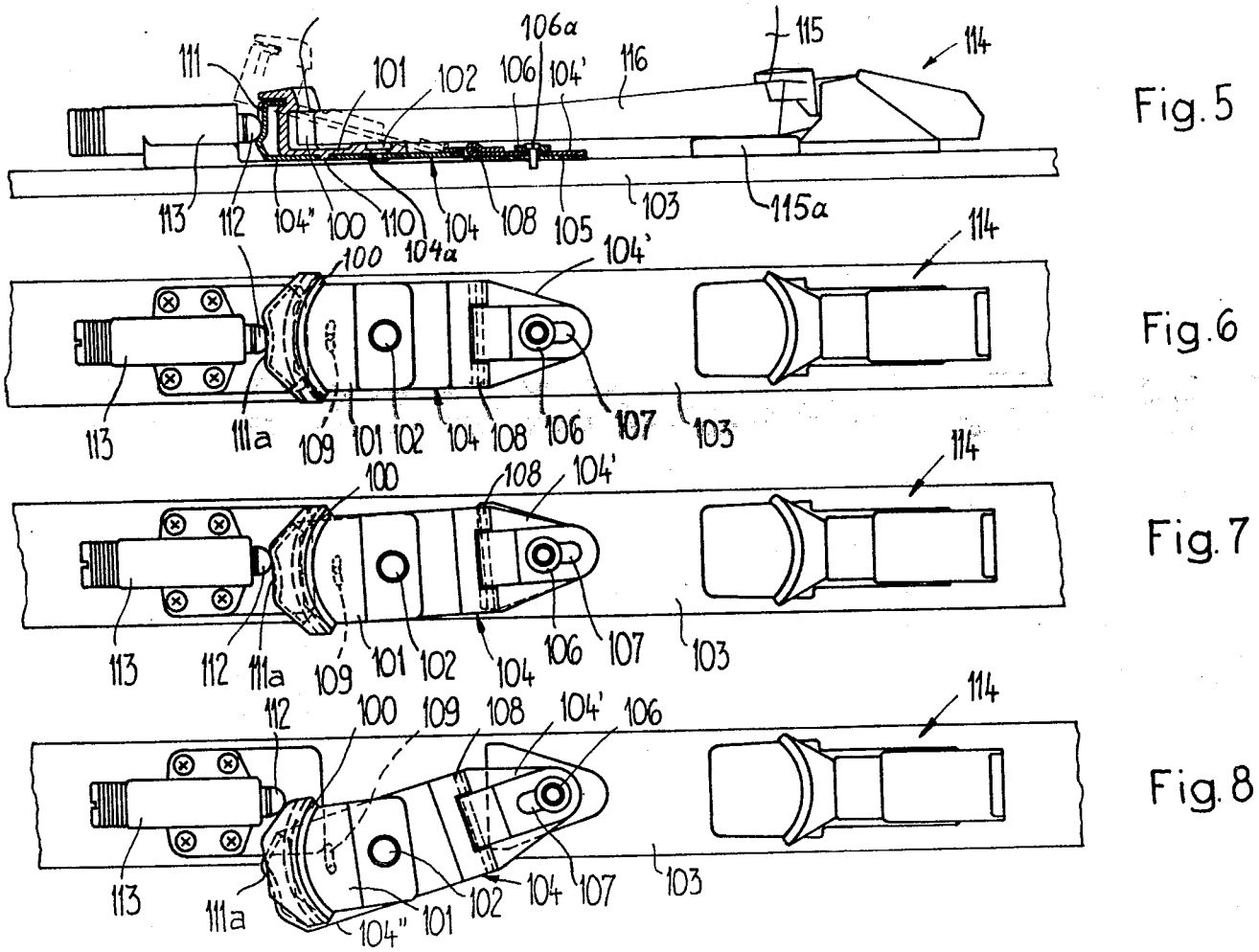
FIG. 5 is a schematic side view of the safety ski binding incorporating the releasable toe holder or jaw according to another exemplary embodiment of the invention.
FIGS. 6, 7 and 8 are respective top plan views showing different operating positions of the releasable toe holder or jaw of the arrangement of FIG. 5.
Figure 1:
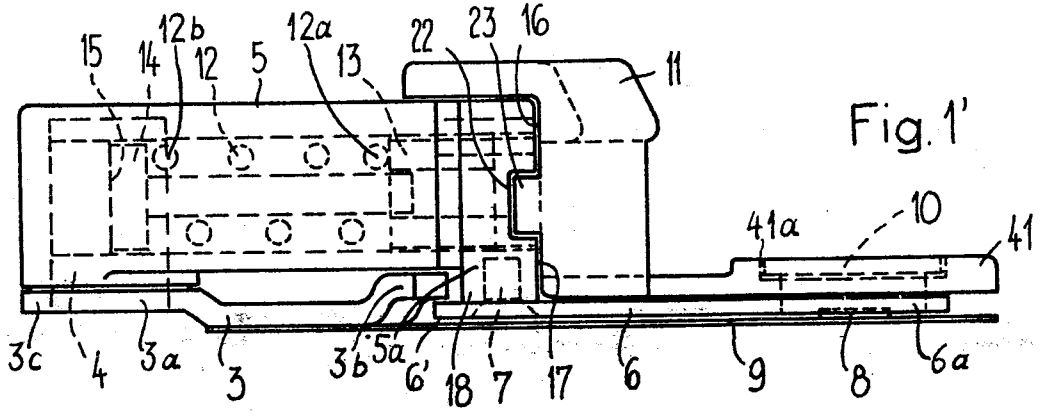
Figure 2:
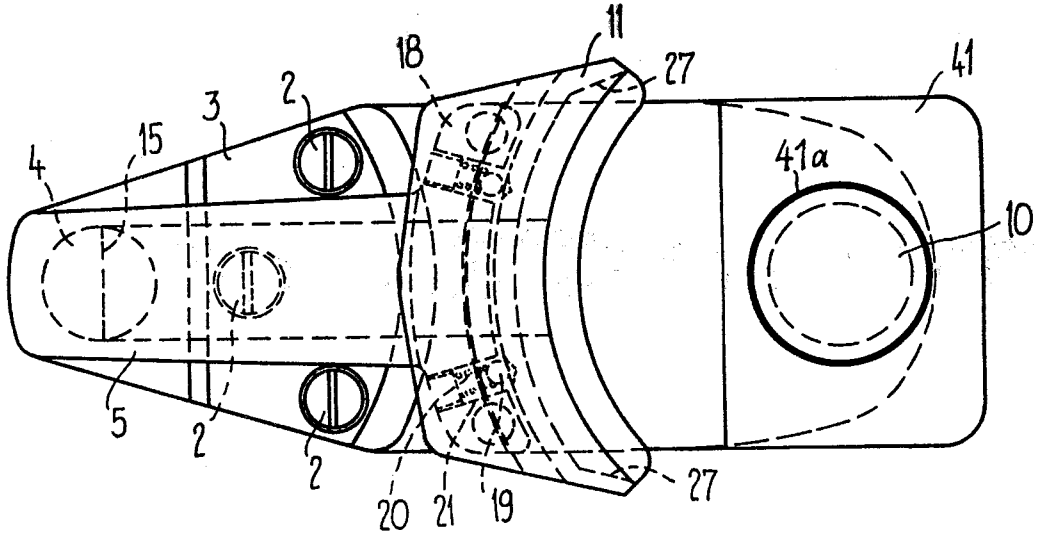

With the exemplary embodiment according to FIGS. 5 to 8 the sole holder 100 likewise has a pedal 101 which is pivotable or rotatable about a pivot pin 102 supported on the ski 103. This pivot pin 102 extends through a hole or aperture 104*a* provided in a pivot or pivotable plate 104, so that the sole holder 100 is pivotable together with this pivot plate 104. At its rear end 104' the pivot plate 104 is supported upon a slide plate 105 which is fixed to the ski 103 and is rockable about a rear pivot pin 106 which is fixedly threaded or screwed to the ski 103. This rear pivot pin 106 extends through an elongate hole or aperture 107 (FIGS. 6 to 8) provided at the rear part 104' of the pivot plate 104 and engages by means of its head portion 106*a* this rear end 104'. The pivot plate 104 thus can rock at this rear pivot point and, additionally, can shift in the lengthwise direction of the elongate hole 107. To this rear end 104' there is mounted by means of a hinge 108 or equivalent structure the front portion or part 104'' of the pivot plate 104, to which there is attached, as already mentioned, the sole holder or holddown member 100 by means of the pivot pin 102. In this front part 104" there is provided a guide slot 109 (FIGS. 6 to 8) into which engages a bolt 110 or equivalent structure which protrudes from the pedal 101. By means of this bolt 110 which engages into the guide slot 109 there is limited the pivotable movement of the sole holder 100 with respect to the pivot plate 104. The front part 104" of the pivot plate 104, as particularly well seen by referring to FIG. 5, is upwardly extended or drawn into a front end portion or part 111. This end portion 111 is provided with a control cam or curved portion 111*a* which coacts with a bolt or locking element 112. This lock or bolt 112 is mounted to be lengthwise displaceable in a locking or bolt housing 113 which is screwed or otherwise fastened to the ski 103 and is biased by a non-illustrated spring which is arranged in the bolt or locking housing 113. This spring presses the bolt or lock 112 against this front end portion 111 of the pivot plate 104 and retains such in the normal position shown in FIG. 6. Reference character 114 designates an automatic heel holder or heel binder which engages over the heel 115*a* of the ski boot 115 and apart from exerting the holddown force at the ski boot sole 116 exerts a forwardly directed contact or pressing force.

The mode of operation of this exemplary embodiment is analogous to the operation of the embodiment shown and discussed above with reference to FIGS. 1 to 4. If a lateral force acts upon the ski boot 115 and if this force exceeds the release value which has been set by means of the spring which bears on the bolt or locking element 112, then the pivot or pivotable plate 104 forming the double link or guide arrangement begins to rock about the pivot pin 106 as has been shown in FIG. 7. The sole holder or holddown member 100 in the elastic range, where there is still possible a return pivoting into the normal position, moves essentially towards the side. The forwardly directed movement component is negligible so that between the pedal 101 and the ski boot sole 116 there practically does not exist any relative movement and the ski boot 115 rotates about the heel 115*a* of such boot. As long as the pivotal or pivot plate 104 and thus also the sole holder 100 is in the elastic range upon disappearance of the aforementioned lateral force, there occurs a return of the pivotal or pivot plate 104 to the normal position shown in FIG. 6.

However, if the pivot plate 104 is rocked past such elastic range, then the bolt or locking element 112 departs from the control cam 111*a* as shown in FIG. 8. Consequently, there is imparted to the pivot plate 104 and together therewith also the sole holder 100 a forwardly directed component bringing about a displacement of the pivot plate 104 in the direction of the elongate hole or aperture 107. The ski boot sole 116 is now released by the sole holder 100 and/or by the automatic heel holder or heel binder 114. After the release action has been accomplished the sole holder 100 can be again effortlessly rocked back into the normal position.

As best seen by referring to FIG. 5, the front support of the pivot plate 104 and the hinge or pivot arrangement 108 also allows for an upward tilting of the front portion 104" of the pivot plate 104 and thus also the sole holder 100. This upward rocking or tilting, which can be triggered by a rearward fall of the skier, likewise results in release of the ski boot sole 116.

While there are shown and described present preferred embodiments of the invention, it is to be distinctly understood that the invention is not limited thereto, but may be otherwise variously embodied and practiced within the scope of the following claims. Accordingly,

What is claimed is:

1. A releasable toe holder for a ski binding, comprising:

a sole holder for holding the toe end of ski boot;

a pedal connected with said sole holder and intended to engage beneath the sole end of a ski boot;

a pivot plate mounted for transverse pivotable movement with respect to the lengthwise direction of the ski and extending below said pedal;

first pivot means provided for said pivot plate to fixedly secure said pivot plate to the ski;

release means acting directly on said pivot plate and comprising a spring element for retaining the pivot plate in a normal position and for returning said pivot plate back into said normal position following a limited transverse movement thereof;

second pivot means provided for said pedal for mounting said pedal on said pivot plate for transverse movement unrestrained by said release means; and said second pivot means being arranged behind said sole holder.

2. The releasable toe holder as defined in claim 1, wherein:

said first pivot means is arranged in front of said sole holder.

3. The releasable toe holder as defined in claim 1, wherein:

said first pivot means is arranged behind said second pivot means.

4. The releasable toe holder as defined in claim 3, wherein:

said first pivot means comprises a pivot pin for rotatably connecting said pivot plate with the ski;

said pivot plate having an elongate hole; and said pivot pin of said first pivot means piercingly extending through said elongate hole of said pivot plate.

5. The releasable toe holder as defined in claim 3, wherein:

said pivot plate comprises hinge means arranged between both of said pivot means in order to upwardly tilt a part of said pivot plate which is connected with said sole holder.

6. The releasable toe holder as defined in claim 1, wherein:

said first pivot means comprises a pivot pin capable of being attached to the ski.

7. The releasable toe holder as defined in claim 1, wherein:

said second pivot means comprises a pivot pin rotatably connecting said pedal with said pivot plate.

8. The releasable ski binding as defined in claim 7, wherein:

said pedal is supportable on the ski; and said pivot pin of said second pivot means is supportable on said ski.

9. The releasable toe holder as defined in claim 1, wherein:

said pedal is supportable on the ski.

* * * * *